United States Patent [19]

Hafstad

[11] Patent Number: 4,533,983

[45] Date of Patent: Aug. 6, 1985

[54] LIGHTING FIXTURES WITH BEAM SUPPORT AND OPPOSITE END CONTACT MEANS

[76] Inventor: Bjorn Hafstad, Flåten, N-5200, Norway

[21] Appl. No.: 419,914

[22] Filed: Sep. 20, 1982

[30] Foreign Application Priority Data

Sep. 21, 1981 [NO] Norway ..... 813193

[51] Int. Cl.[3] ..... F21V 15/00

[52] U.S. Cl. ..... 362/223; 362/225; 362/311; 362/260; 362/240; 362/368; 362/375; 362/249; 362/432; 52/731

[58] Field of Search ..... 362/217, 267, 432, 368, 362/225, 388, 240, 223, 249, 311, 260, 375; 52/723, 726, 729, 731; 248/219.4

[56] References Cited

U.S. PATENT DOCUMENTS

| | | | |
|---|---|---|---|
| 2,907,868 | 10/1959 | Henschel | 362/267 X |
| 3,098,167 | 7/1963 | Jensen et al. | 362/267 X |
| 3,398,498 | 8/1968 | Krauss | 52/723 X |
| 3,474,243 | 10/1969 | Miller | 362/267 X |
| 3,514,591 | 5/1970 | De Vos | 248/219.4 X |
| 3,569,692 | 3/1971 | Johnson et al. | 362/267 |
| 3,743,332 | 7/1973 | Sonolet | 52/726 X |
| 4,245,281 | 1/1981 | Ziaylek, Jr. | 362/267 X |
| 4,246,629 | 1/1981 | Marrero | 362/432 X |
| 4,290,098 | 9/1981 | Pierson | 362/267 |
| 4,360,859 | 11/1982 | Ziaylek, Jr. | 362/267 X |
| 4,383,287 | 5/1983 | Fette | 362/67 X |

FOREIGN PATENT DOCUMENTS

| | | | |
|---|---|---|---|
| 570835 | 2/1959 | Canada | 362/432 |
| 1116103 | 8/1960 | Fed. Rep. of Germany | 362/267 |
| 955659 | 4/1964 | United Kingdom | 362/388 |

*Primary Examiner*—Peter A. Nelson

*Attorney, Agent, or Firm*—Kenyon & Kenyon

[57] ABSTRACT

Electrical lighting fixture (10) with holder (19) for light tubes (22) or lamp bulbs (228), where at opposite ends the holder supports contact-forming means (20, 21) for the support of one or more light tubes freely hanging between the contact-forming means in a horizontal or substantially horizontal position or for the support of a series of lamp bulbs, and where the holder also forms a support for a transparent cover (17). The holder comprises a rigid, self-supporting support beam (24, 124, 224) which projects free endedly outwards from a fastening at its one end (23, 223), with the light tube or tubes (22) and with the light bulbs (228) extending parallel to or across the support beam. The cover (17), which surrounds the support beam with associated light tubes or lamp bulbs, has an elongate container-forming shape and is adapted to be secured only at its one end, that is to say at the opening of the container just by the inner end of the support beam. The support beam forms a support for the container-forming cover (17) in at least a region axially within the opening of the container.

11 Claims, 10 Drawing Figures

LIGHTING FIXTURES WITH BEAM SUPPORT AND OPPOSITE END CONTACT MEANS

This invention relates to lighting fixtures with a holder for light tubes or lamp bulbs and a transparent cover supported by the holder.

On using an electrical fixture with light tubes or lamp bulbs under the open sky, there are several things to be considered in order that the fixture will function satisfactorily. Firstly, the light tube or tubes or the lamp bulbs have to be protected against weather and wind, including driving rain and high humidity possibly in combination with changing temperatures together with large wind pressures, accidental pressure loadings, blows and the like. Especially significant problems can be had with fixtures having light tubes which are utilised on board ship, on board oil and gas bore rigs and at similar use locations where there is a danger of gas explosion. Big problems can also occur in such instances where the fixture is to be used in a submerged condition, for example, submerged in a tank.

It is apparent that there is a need for water-tight and gas-tight seals between parts which surround the light tube or tubes or the lamp bulbs, in order to prevent the penetration of moisture and exposively dangerous gas to the light tubes or lamp bulbs. At the same time, it is necessary that possible explosions within the fixture are not able to be transmitted to the explosively dangerous atmosphere which has to surround the fixture. There is also the need of being able to provide a sufficiently robust construction to be able to withstand the effects of weather and wind, sun heat, accidental shocks and vibrations on board ship and the like. There is a further need of being able to obtain ready replacement of light tubes or light bulbs at the location of use, without thereby risking leakage of moisture and/or gases to the newly installed light tubes or light bulbs.

A conventional construction of a holder for light tubes consists of a mounting plate which runs parallel to the light tubes, and where contact means of the light tubes and associated light tubes project laterally outwards from the plate. The mounting plate is carried in a rigid, inverted bowl-shaped or inverted trough-shaped lid which covers up the light tube or tubes together with the mounting plate on their upper sides, while a transparent cover, which has a bowl-shaped or trough-shaped construction, covers the light tube or tubes together with the mounting plate on the under side. As a consequence of the elongate sealing surfaces between lid and cover, it is generally difficult to obtain a uniform and reliable seal. This is further complicated by a need for a large number of fastening means, this requirement creating further difficulty in achieving ready replacement of light tubes.

According to another known construction which is employed on board ship and in other exposed use locations, there is utilised a pipe-shaped, transparent cover which is squeezed together, together with the light tube or tubes, between two opposing base members which carry light tube contacts and the like. The base members can be secured separately to a wall or another support. The base members can, to a certain degree, be squeezed together into sealing abutment against the intermediate pipe-shaped, transparent cover. The base members can, for example, be clamped together against each other by means of parallel extending bars which, together with the base members, form a rigid, external support means for the cover and the confined light tube(s). By means of nuts and/or regulating screws, the sealing abutment between the base members and the cover can be regulated. On replacing the light tube, it is a laborious task to dismantle the cover from the base members and a still more laborious task to mount the cover in position again with the desired accurate sealing between the parts. Problems are especially created in effecting replacement of light tubes in the open sea under the stresses of weather and wind and possibly, at the same time, cold and heavy seas.

A conventionally known construction for holders for a simple light bulb consists of a base member to which the light bulb can be fixed in a protected manner inside an outer glass globe which can be secured with screw threads to the base member. By the use of several light bulbs in one and the same fixture, there have been problems in obtaining sufficient protection of the lamp bulbs while these are readily accessible for replacement.

With the present invention, the aim is a solution where, with the aid of simple means, easy dismantling and mounting of the cover can be achieved and where, nevertheless, there can be ensured an effective sealing between the cover and adjacent parts. Besides, the aim is a solution which is designed with a robust construction having a low weight and with the possibility for inexpensive production.

According to the present invention a lighting fixture comprises a holder for supporting a lamp device, a transparent casing surrounding the lamp device and also supported by the holder and a base member adapted to be secured to a permanent support and having said holder and the casing secured thereto. The casing has the form of an elongate container and is adapted to be secured only at its one open end while being supported in at least one region axially within the opening of the container.

In one embodiment, the lamp device is at least one light tube or a series of lamp bulbs, the holder supporting at its opposite ends contact means for the support of said light tube while hanging freely therebetween in a substantially horizontal position of the contact means for the lamp bulbs. The holder comprises a rigid, self-supporting support beam projecting in cantilever manner from its fastened end with at least one light tube or a series of lamp bulbs extending parallel to or across the support being. The casing surrounds the support beam and is adapted to be secured at its opening adjacent the inner end of the support beam.

By designing the support beam of the fixture as a rigid, self-supporting construction which projects freely outwards from a fastening means at its one end, it is possible to fasten in place a casing or cover of elongate form to the associated fastening means in a relatively simple manner so that a reliable seal can be readily obtained between the parts. Such a favourable mode of fastening is made possible due to the employment of an elongate container-forming cover which only needs to be fastened at its one end, the support beam forming a support and guide for the cover axially within the opening of the container. The casing can thus be controlled and supported in a reliable manner on the support beam during application and withdrawal of the cover, without thereby needing to touch the light tube or tubes and the light bulbs respectively. Furthermore, the casing can be supported in a correspondingly effective manner during use via the internal support. In this way, it is possible to manufacture the casing or cover from relatively inexpensive material which does not necessarily need to have a wholly rigid, self-supporting construction.

In another embodiment, the holder of the lighting fixture has a disc-shaped fastening member forming its innermost end. In addition, the holder is provided with contact-forming means supporting a U-shaped light tube, a rectangular pipe stump projecting outwardly endways from the fastening member, a cylindrical support pipe detachably mounted towards its one end at one side of the stump while its outer end is secured to a support sleeve, a guide plate mounted in position between leg portions of the U-shaped light tube and snap-fittingly engaging the support sleeve, and a guide disc fitting externally on the leg portions of the light tube and self-lockingly and snap-fittingly engaging said guide plate. The peripheral surfaces of the disc-shaped fastening member and said guide disc have outer diameters substantially corresponding to the inner diameter of the casing so that the surfaces fit tightly to the casing.

In order that the invention can be more clearly understood, convenient embodiments thereof will now be described, by way of example, with reference to the accompanying drawings in which.

Figure 1:
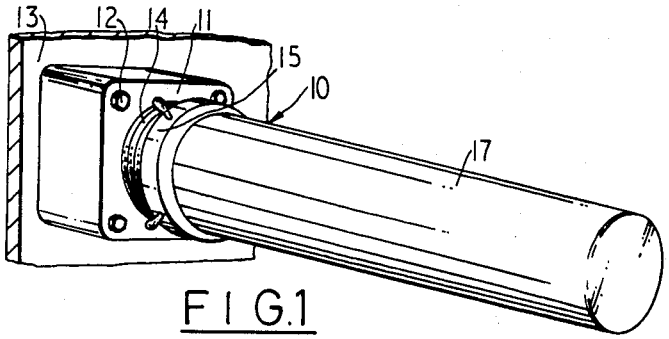
FIG. 1 is a perspective view of a lighting fixture projecting in cantilever manner from a fastening on a wall.
Figure 2:
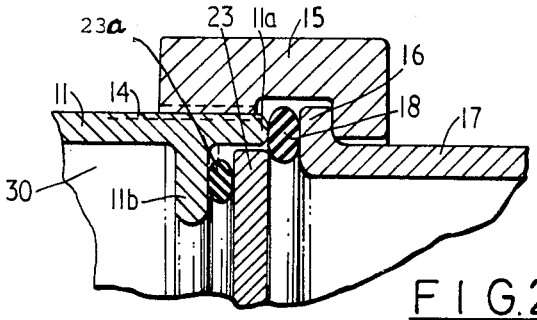
FIG. 2 is a cross-section of the opening portion of the container-forming casing and its abutment against a socket portion of the lamp.
Figure 3:
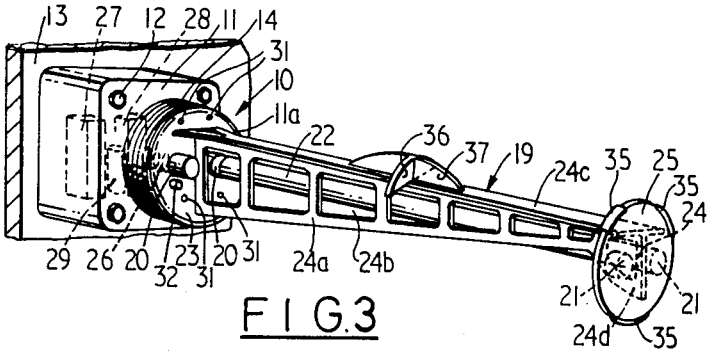
FIG. 3 is a perspective view similar to FIG. 1 but with the casing and one of two light tubes of the fixture removed for the sake of simplicity.

Referring to FIGS. 1–3, fixture 10 comprises a base member 11 which has an approximately rectangular bottom portion. The base member 11 is fastened with screw bolts 12 via holes in the wall portion of the base member 11 to a wall 13. The base member 11 is provided externally at an axially outwardly projecting collar portion with external threads 14 which cooperate with corresponding internal threads on a clamping ring 15 which fixes an end flange 16 (FIG. 2) on a container-forming cover casing 17 of transparent material against end edge 11*a* of the base member. Between end edge 11*a* of the base member 11 and end flange 16 of the cover 17, there is inserted a sealing ring 18 (see FIG. 2). The sealing ring 18 can, for example, be permanently secured to the end flange 16 of the cover 17 so that it can be removed from the base member 11 together with the cover 17.

In FIG. 3, the fixture is illustrated after the cover 17 and its associated clamping ring are removed. From the base member 11, there projects endways outwards a holder 19 with two pairs of contact means 20, 21 for two associated light tubes, of which only one light tube 22 is shown. One pair of contact means 20 is fixed in openings in a first cover-forming disc 23 on a support beam 24, while the other pair of contact means 21 is fixed to the outer side of another cover-forming disc 25 on the opposite, free outwardly projecting end of the support beam 24. The light tube 22 is suspended in a horizontal or substantially horizontal position and hangs freely between its opposite ends which cooperate with their respective contact means 20 and 21. The contact means 20 which pass through the disc 23 are preferably axially moveable from an outer use position against the force of a compression spring 26 (shown in broken lines) to an inner, axially pushed-in, inactive position for installation and removal of the light tube. In the construction shown, the contact means 20 are not turnable, that is to say they are exclusively axially moveable and self-centering while the contact means 21 are neither turnable nor axially moveable.

The support beam 24 which is of skeletal construction has a generally T-shaped cross-section with a main portion 24*a* which is perforated with openings 24*b* and which form vertical web portions in the support beam, together with an upper cross-piece 24*c* which extends in a straight line (band-shaped) along the major portion of the axial dimension of the beam. The beam is anchored at opposite ends to its respective discs 23 and 25. The main portion 24*a* of the support beam has a declining height in the longitudinal direction of the beam reckoned from the cover-forming disc 23 to the outer disc 25. At 24*d* there is shown a diagonal member between the lower end edge of the beam 24 and the lower end edge of the disc 25.

In the embodiment which is illustrated in FIG. 3, the support beam 24 is produced with the associated discs 23 and 25 in one piece by die casting of light metal.

In FIG. 3, there is indicated, by broken lines, a choke coil 27, a condenser 28 and a radio noise filter 29 received in a hollow space 30 (FIG. 2) which is formed between the saucer-shaped bottom portion of the base member 11 and the cover-forming disc 23 of the support beam 24. The cover-forming disc 23 which is supported by the beam 24 is secured internally in the base member 11 and squeezed against an inner flange 11*b* (FIG. 2) of the base member 11 via a sealing rings by means of one or two pairs of fastening screws 31 (FIG. 3). On mounting the support beam 24 via the disc 23 to the base member 11, the hollow space with the electrical components 27, 28, 29 is covered in a fluid- and gas-tight manner by the disc 23 and associated sealing rings. A glow lighter is easily replaceably fixed to the outwardly directed side of the disc 23, just by the side of the light tubes 22.

In FIG. 3, there is shown a support and guide device for the inner, closed end portion of the container-forming cover 17 on the peripheral edge of the disc 25 where there are applied, in sections, elastically yielding band pieces 35 of vibration-absorbing material for the subdueing of possible vibratory movements between the cover 17 and the holder 18 at the closed outer end of the cover. At the central portion of the holder 19, there is arranged a support and guide device for the cover 17 on the support beam 24 at a suitable level above the top side of the support beam. The support and guide device is formed by a first convexly curved projection 37 which extends along the holder 19 and a second convexly curved projection 36 which extends across the holder 19 and across the projection 37. If desired, additional or similar projections can be arranged on the beam 24 at various distances from the disc 23 for the local guidance and support of the cover 17. In this way, slow movement of the cover downwards between the ends and the formation of an abutment against the top side of the beam or against the two light tubes can be prevented. Support and guide devices can also prevent blows or pressure against the cover being transmitted to the light tubes.

Figure 4:
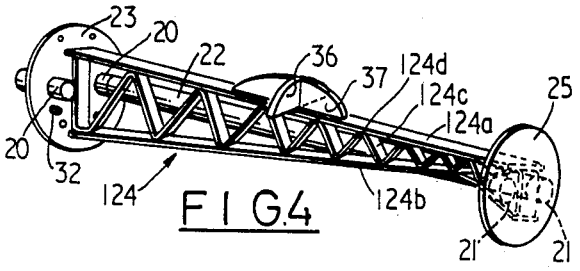
FIG. 4 is a perspective view of a lighting fixture according to a second embodiment.

According to an alternative construction as shown in FIG. 4, the support beam 124 is also, in this instance, made in one piece but is constructed of band-shaped material substantially of I-shaped cross-section. The beam 124 comprises a first band 124*a* which formes an upper cross-piece of the support beam and a second band 124*b* which forms a lower cross-piece of the support beam together with a third band 124*c* which runs in a zig-zag shape between the bands 124*a*, 124*b* to form the vertical web. By means of spot welding 124*d* or similar fastening means, the band 124*c* is secured at point locations to said bands 124*a*, 124*b*. The bands 124*a*, 124*b* and 124*c* are secured in a corresponding manner to the discs 23 and 25 by spot welding or with similar fastening means.

Figure 5:
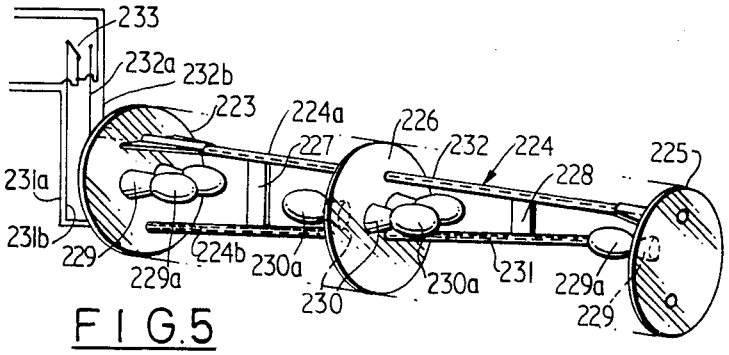
FIG. 5 is a perspective view of a lighting fixture according to a third embodiment designed for a series of lamp bulbs.

In a third construction of the fixture, as shown in FIG. 5, only the support beam 224 is illustrated, the cover and the base member being similar to those shown in the remaining constructions and being left out for the sake of simplicity.

The support beam 224 consists of a first, upper pipe member 224*a* and another, lower pipe member 224*b* which are secured to three transverse, plane, circular discs 223, 225 and 226 via holes in the discs suited for this purpose. The pipe members 224*a* and 224*b* constitute together with the discs 223, 225 and 226 a rigid construction of unitary form. In the illustrated embodiment, the pipe members 224*a* and 224*b* are additionally reinforced by means of transverse band-shaped reinforcing pieces 227 and 228 which are disposed between their respective pairs of disc members 223, 226 and 226, 225.

To each of the discs 223 and 225, there are fastened a pair of mutually oppositely directed contact-forming light bulb sockets 229 while there is fastened to the middle disc 226, a pair of light bulb sockets 230 to each of its opposite sides. At 229*a* and 230*a* there are shown conventional light bulbs.

In the lower pipe member 224*b*, there extend current leads 231 (shown in broken lines) with associated branches to each of the light bulb sockets 229, 230. In the upper pipe member 224*l*, there extends a heating cable 232 (shown in broken lines) or a corresponding heating element. The current circuit 232*a*, 232*b* of the heating cable 232 is coupled together with the current circuit 231*a*, 231*b* of the light bulbs via a turning breaker 233. In the uncoupled state of the light bulbs, the heating cable is coupled while the heating cable is correspondingly uncoupled in the coupled state of the light bulbs. It can be ensured that the effective consumption in the uncoupled state of the light bulbs is rather low and provides only for sufficient heat to counteract the formation of condensation within the illuminating fixture, that is within the cover (not shown) of the fixture. The disc 226 forms, in a manner corresponding to the projections 36, an internal support for the cover between its ends.

Figure 6:
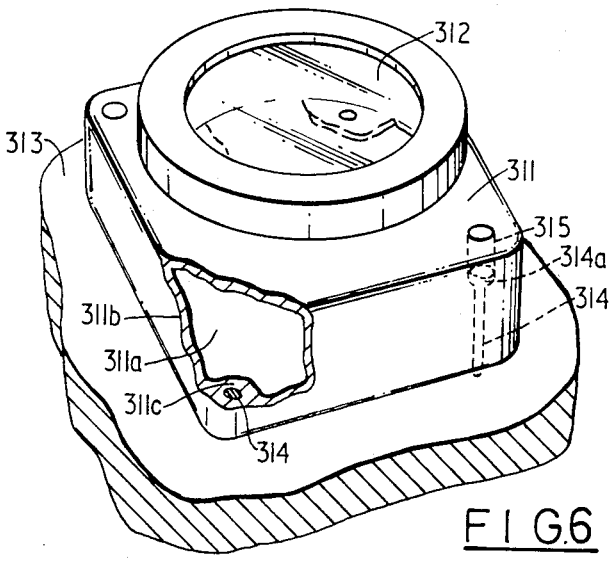
FIG. 6 is a perspective view, partly in section, of a base member in a covered inactive position.

In FIG. 6, there is shown a separate base member 311 which is secured to a support wall 313 in an inactive position, ready for mounting of support beam and associated cover, immediately there is a need for this. In the inactive position shown, the base member is covered with a glass plate (Plexi-glass plate) 312 instead of the cover 17 shown according to FIG. 2.

In a cut-out portion of the base member 311, there is shown bottom 311*a* of the base member which forms a supporting abutment against the supporting wall 313. Fastening screws 314 of the base member pass through holes 315 in thickened corner portions 311*b* of walls 311*c* of the base member, head 314*a* of the fastening screw 314 being countersunk in the hole 315 so that the outer portion of the hole can be sealed tight with silicon material or similar sealing means. On the mounting of a fixture, the glass plate 312 can be removed and, thereafter, the support beam and associated light tubes or light bulbs together with the cover can be readily mounted in position, in sequence. Provision is made for an open air flow connection between the space within the base member and the space outside the base member as defined by the cover.

The container-forming cover is shown with a cylindrical main portion in the illustrated embodiment but can in practice have, arbitrarily, another elongate container-forming shape. Instead of the two light tubes which the holder of the embodiments illustrated in FIGS. 1–4 is designed for, the holder can be designed for the reception of one simple light tube or more than the two light tubes illustrated. Instead of the eight light bulbs illustrated according to the construction of FIG. 5, there can be employed a larger or smaller number of light bulbs or light tubes where this is most desirable.

The space which is formed within the cover around the light tubes or around the light bulbs can, if necessary, be supplied with an excess pressure of inert gas from a suitable source of inert gas via a conduit connection through the wall 13 and the base member 11. The space which is formed between the base member 11 and the end part 23 can correspondingly be supplied with inert gas from a source of inert gas via a conduit connection through the bottom of the base member.

Figure 7:
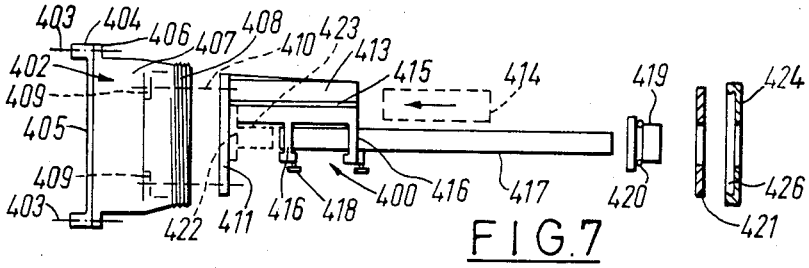
FIG. 7 is a side view, partly in section, of a lighting fixture according to a fourth embodiment in which the holder is designed for a U-shaped light tube and certain parts are axially withdrawn from each other.
Figure 8:
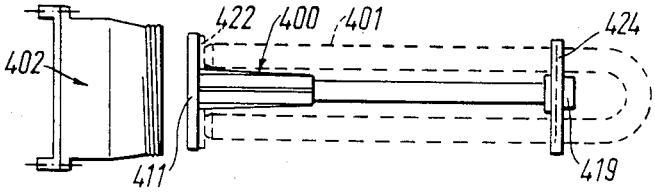
FIG. 8 is a side view of the lighting fixture of FIG. 7 showing the parts of the holder and an associated light tube assembled together ready for mounting in a base member.
Figure 9:
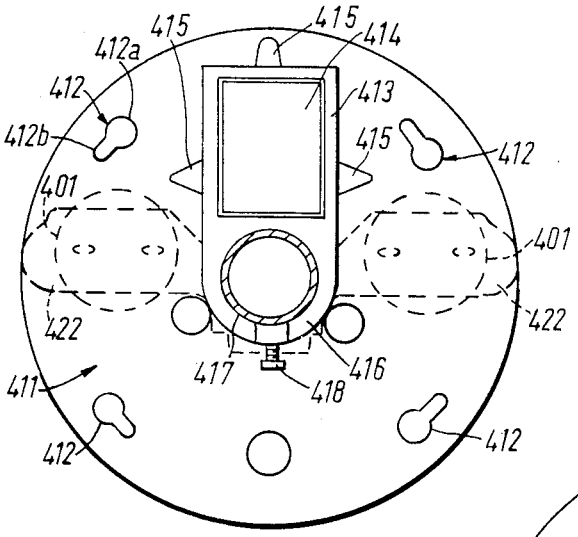
FIG. 9 is an end view of the holder of the lighting fixture of FIGS. 7 and 8 shown on an enlarged scale.
Figure 10:
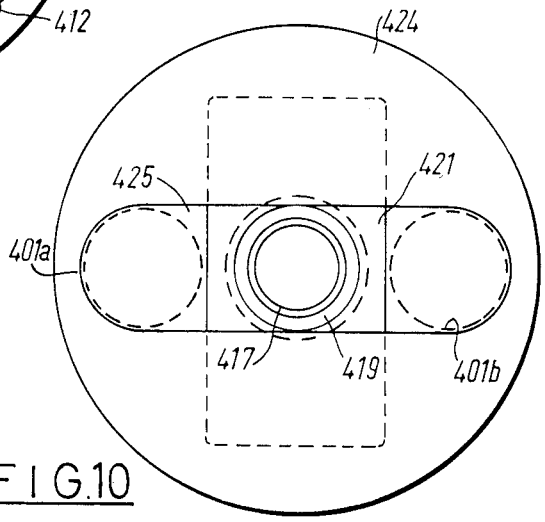
FIG. 10 is an end view of a support arrangment mounted between the holder of the lighting fixture of FIGS. 7 and 8 and the light tube adjacent their outer ends.

Referring to FIGS. 7–10, a holder 400 is shown specifically designed for a U-shaped light tube 401 which is represented by broken lines in FIGS. 8, 9 and 10. A base member 402 is fixed to a wall foundation via fastening screws 403 represented by chain lines in FIG. 7. The screws 403 pass through fastening lugs 404 in a bottom plate 405 and flush fastening lugs 406 in a cover-shaped element 407. At the opposite end of element 407 there are designed external screw threads 408 for screwing on a clamping ring similar to ring 15 shown in FIGS. 1 and 2 and fastened by the latter is a container-forming cover similar to cover 17 shown in FIGS. 1 and 2. Internally in the base element 407 there projects radially inwards four diametrically separate lugs 409 with associated screw-threaded holes for the reception of a fastening screw shown by broken lines 410 in FIG. 7 and having a screw head projecting outwards in the axial direction of the cover-shaped base element 407.

The holder 400 supports innermost a circular disc-shaped fastening member 411 having four keyhole-shaped openings 412 for the reception of respective screw heads in a first opening portion 412*a* and for the reception of respective screw stems in another adjacent opening portion 412*b*. The fastening member 411 of the holder can consequently be secured to lugs 409 of the base element 407 via its screws by axial displacement of the fastening member in the base element followed by an angular turn of a few degrees between the fastening member and screws 410 of lugs 409.

In FIG. 7, the holder 400 is adapted to be pushed into the base member in a first angular position while in FIG. 8 the holder is adapted to be pushed into the base member in another angular position turned at an angle of 90° relative to the angular position shown in FIG. 7. After the base member 402 is fastened on the wall, the holder can be fixed in various angular positions at 90° intervals so that the light tube 401 can be adjusted with the main plane in a vertical or horizontal direction as required.

A rectangular pipe stump 413 projects in cantilever manner from the fastening member 411 and is internally adapted to receive a choke coil 414 (shown in broken lines in FIG. 7). The pipe stump is provided on three of its side surfaces with reinforcing ribs 415 and is provided on the fourth side surface with two mutually separate ears 416 each having a hole for the reception of a cylindrical support pipe 417. The support pipe 417 is readily detachably secured to the support ears 416 by means of fastening screws 418. On the outer end of support pipe 417 there is secured (see FIG. 8) a support sleeve 419 with an annular groove 420 for the reception of an inner opening edge of a guide plate 421 in snap engagement with the sleeve 419. After the light tube 401 is fixed in position in contact-forming members 422 (shown in broken lines in FIGS. 7, 8 and 9) on fastening member 411 and thereafter there is fixed in place a glow lamp 423 (shown in broken lines in FIG. 7), the guide plate 421 is pushed into position in the opening between leg portions 401*a* and 401*b* of the light tube 401 as shown in FIG. 10. Finally a guide disc 424 is threaded into position outside the light tube 401 which is received in a gap 425 in the disc 424. The guide plate 421 is accommodated in a recess 426 in the disc 424 so that the plate 421 and the disc 424 can be clamped together in a self-locking, snap-fit engagement. The circular peripheral surfaces of the fastening member 411 and the guide disc 424 have an outer diameter which corresponds substantially to the inner diameter of the container-forming cover not shown so that they can fit tightly to the cover in arbitrary angular positions of the holder relative to the base member.

I claim:

1. A lighting fixture comprising a base member adapted to be secured to a permanent support;

a holder for supporting a lamp device, said holder including a rigid self-supporting support beam fastened at one end to said base member and projecting outwardly from said base member;

a transparent elongate casing having an open end secured to said base member and surrounding said holder, said casing being supported on an outer end of said beam spaced from said base member; and contact means at opposite ends of said holder for a lamp device.

2. A lighting fixture as set forth in claim 1 wherein said holder includes a pair of discs, each of said discs being disposed at a respective end of said beam with one disc mounted on said base member and the other of said discs supporting said cover.

3. A lighting fixture as set forth in claim 2 wherein said support beam is of skeletal construction.

4. A lighting fixture as set forth in claim 2 wherein said support beam includes a pair of pipes secured to said discs.

5. A lighting fixture as set forth in claim 4 which further comprises a heating element in one of said pipes, electrical beads in the other of said pipes and electrical contacts on said discs electrically connected to said leads.

6. A lighting fixture as set forth in claim 1 wherein said base member has a recess receiving one end of said holder and a clamping ring securing said casing and said holder to said base member.

7. A lighting fixture as set forth in claim 1 further comprising a lamp device selected from the group consisting of at least one light tube extending parallel to said support beam and a series of lamp bulbs extending across said support beam.

8. A fixture set forth in claim 1 which further comprises a clamping ring securing said casing and said holder to said base member.

9. A lighting fixture comprising a base member adapted to be secured to a permanent support;

a holder for supporting a lamp device, said holder including a rigid self-supporting support beam fastened at one end to said base and projecting outwardly from said base member, said support beam having longitudinal, pipe-shaped reinforcing means and transverse disc-shaped reinforcing means, said disc-shaped reinforcing means forming fastenings for light bulb sockets arranged in series in the longitudinal direction of the fixture;

a transparent elongate casing having an open end secured to said base member and surrounding said holder, said casing being supported on said beam in at least one region axially of said casing and spaced from said base member;

contact means at opposite ends of said holder for a lamp device; and a lamp device selected from the group consisting of at least one light tube extending parallel to said support beam and a series of lamp bulbs extending across said support beam.

10. A lighting fixture comprising a base member adapted to be secured to a permanent support;

a holder for supporting a lamp device, said holder including a disc-shaped fastening member at one end, a rectangular pipe stump projecting from said fastening member, a cylindrical support pipe detachably secured at one end to said stump, a support sleeve secured to an opposite end of said stump, a guide plate mounted on said support sleeve for positioning between leg portions of the light tube, and a guide disc fitting externally over the light tube and snap-fitted to said guide plate; and a transparent elongate casing having an open end secured to said base member and surrounding said holder, said casing being supported on peripheral surfaces of said fastening member and said guide disc and spaced from said base member.

11. A fixture as set forth in claim 10 wherein said holder is adapted to be mounted in said base member in positions at 90° to one another so that the light tube can be adjusted with a plane in both vertical and horizontal positions.

* * * * *

UNITED STATES PATENT AND TRADEMARK OFFICE

CERTIFICATE OF CORRECTION

PATENT NO. : 4,533,983

DATED : August 6, 1985

INVENTOR(S) : Bjorn Hafstad

It is certified that error appears in the above-identified patent and that said Letters Patent is hereby corrected as shown below:

Column 1, line 26 change "exposively" to - explosively-
Column 2, line 32 change "said" to -the-
Column 2, line 41 change "said" to -the-
Column 2, line 42 change "of the contact" to -or contact-
Column 3, line 16 change "said" to -the-
Column 3, line 18 change "said" to -the-
Column 3, line 65 change "cover casing" to -cover or casing-
Column 5, line 22 change "formes" to -forms-
Column 5, line 59 change "2241" to -224a-
Column 8, line 67 change "a plane" to -a main plane- Signed and Sealed this

*Thirty-first* Day of *December 1985*

[SEAL]

*Attest:*

DONALD J. QUIGG

*Attesting Officer*

*Commissioner of Patents and Trademarks*